US006150594A

United States Patent [19]

Fiondella et al.

[11] Patent Number: 6,150,594

[45] Date of Patent: Nov. 21, 2000

[54] DRUMMING APPARATUS

[75] Inventors: Michael Harry Fiondella; Jennifer Vitale Fiondella, both of Bethany, Conn.

[73] Assignee: The Mike Fiondella School of Drumming L.L.C., Bethany, Conn.

[21] Appl. No.: 09/192,141

[22] Filed: Nov. 14, 1998

[51] Int. Cl.[7] ..... G10D 13/02

[52] U.S. Cl. ..... 84/411 R; 84/414; 84/419; 84/421; 84/422.4

[58] Field of Search ..... 84/411 R, 418, 84/419, 420, 422.4, 414, 421, 327

[56] References Cited

U.S. PATENT DOCUMENTS

| | | | |
|---|---|---|---|
| 1,803,173 | 3/1931 | Converse . | |
| 2,559,739 | 7/1951 | Sherman | 211/70 |
| 2,620,703 | 12/1952 | Lebensfeld et al. . | |
| 3,055,253 | 9/1962 | Loughborough | 84/411 R |
| 3,867,863 | 2/1975 | Vennola . | |
| 4,045,264 | 8/1977 | Ludwig . | |
| 4,385,544 | 5/1983 | Heiskell | 84/422.4 |
| 4,452,121 | 6/1984 | Green . | |
| 4,567,807 | 2/1986 | Robinson | 84/411 M |
| 4,632,006 | 12/1986 | Ambroszewski | 84/422.4 |
| 4,787,876 | 11/1988 | Nguyen et al. | 446/408 |
| 5,280,742 | 1/1994 | Vergara | 84/411 R |
| 5,892,168 | 4/1999 | Donohoe | 84/411 M |

*Primary Examiner*—Stanley J. Witkowski
*Assistant Examiner*—Shih-yung Hsieh

[57] ABSTRACT

The present invention is a drumming apparatus or percussion instrument used for drumming comprising a drum and drum sticks. The drum comprises a plastic bucket shaped shell covered with a soft felt material and each drum stick comprises a cylindrically shaped elongated member covered with a soft felt material. The combination of the drum and drum sticks provide a unique tone or sound which is suitable for home, school and other environments where certain drumming noises could be bothersome. Multiple sizes of the drum can be combined to produce many unique sounds and pitches. Further the drum can be fastened together in several configurations, with or without a stand to form a drumming apparatus or a drum set. The preferred method of attaching multiple drums is by use of a fastening system such as, for example, Velcro™. Also, the drum apparatus, which is lightweight and portable, can be easily stacked and stored because of the bucket like shape of the drums.

18 Claims, 2 Drawing Sheets

DRUMMING APPARATUS

FIELD OF THE INVENTION

The present invention relates to the field of percussion musical instruments and in particular an apparatus for drumming.

BACKGROUND OF THE INVENTION

Drum or percussion instruments which are usually rhythmic in function and have tone or sound characteristics which are produced by a person or group of people, by striking or shaking the instrument(s). Tone is a physical property of music that is produced by regular vibrations of the air, such as those produced by singing or whistling. Tone's regular vibrations are unlike common noise that is produced by irregular vibrations of air like those caused by an explosion or breaking of a dinner plate. Musical tone has four properties: 1) pitch; 2) duration; 3) intensity and 4) quality. Pitch is the highness or lowness of the tonal sound. A higher pitch is caused by faster vibrations and a lower pitch is caused by slower vibrations. Human hearing is in the range of approximately 15 vibrations per second to about 20,000 vibrations per second. Duration is the length of time a tone is sustained. Intensity is the degree of loudness and softness of the instrument. Intensity is a basis of musical rhythm. Sounds which are quick in duration and vary in intensity can produce rhythm within a musical phrase. All musical tone has a characteristic quality. This quality enables an individual to distinguish the differences between different instruments, such as, for example, the differences between a flute, a piano and a drum. The quality of tone is also referred to as timbre, tone quality or tone color. These four properties give many instruments infinite sound possibilities in the musical field. Rhythm is the time element of music.

There are two groups of percussion instruments, a group of definite pitch instruments and a group of indefinite pitch instruments. The definite pitch instrument group includes, for example, the kettledrums or timpani and the marimba. Definite pitch instruments have pitches which are melodic and rhythmic in function. The indefinite pitch instrument group includes, for example, the snare drum, bass drum and cymbals. Indefinite pitch instruments usually are rhythmic in function. Different tones can be provided by providing different size drums.

Drumming in one form or another has been taking place for as long as anyone can remember. Primitive man would stamp on the ground. Later in history hollowed wood was struck with the hands, sticks or other objects. Eventually hollowed wood or a wooden shell was covered at one or two ends with an animal skin which was then used as the striking surface. More recent developments covered a wooden shell or metal shell with plastic drumming heads which are struck with a pair of drum sticks usually made of wood. A common percussion instrument, the snare drum, uses a shell where one end is covered with a plastic drum head or batter head, as it is called and the second end of the shell is covered with a snare head or thinner plastic head, with strands of material that are against the thinner head. This produces a sizzle like sound when the drum is struck. Another common percussion instrument, the tenor drum typically has a batter head attached at one or both ends of the drum shell. Each size tenor drum will produce its own pitch. The smaller the drum, the higher the vibrations and therefore the higher the pitch. The snare drum and tenor drum are popular drums for home use. However, these drums have disadvantages. They are difficult to transport because of their size and they have many fastening lugs which require a special tool for fastening and unfastening the drum heads. Also, the heads wear out and are expensive to replace.

While the prior technology used to develop, fabricate and utilize a drumming instrument works well in many situations, it is deficient in other situations. Snare drums, tenor drums and other popular percussion instruments performed in areas possessing proper acoustical properties can sound well and have a proper tonal color. These areas may have sound proofing material, as in a sound studio, or may be in the outdoors not close to any hard building walls or objects which the drum sounds can reverberate off of. Without these proper surroundings, the drums could sound much more noisy and annoying as opposed to tonal. In most average surroundings, such as in a typical school, neighborhood or home environment, having proper surroundings for producing good acoustical properties is not obtainable or can be very expensive for the average consumer to obtain. Electronic drumming equipment has volume and tone characteristic settings which can be more easily controlled, but the electronic equipment required, such as power supplies, electric drum pad, and amplifiers are expensive and occupies a large amount of space and is difficult to transport. Thus, popular, commonly used drums have disadvantages of expense, and poor tone when played in common environments such as homes and schools.

Vennola, U.S. Pat. No. 3,867,863 discloses a toy drum having an open-ended cylindrical shell of paper based material and a plastic drum head at each end. The paper construction of Vennola is not durable enough to stand up to rough playing and portability. Further, the plastic drum heads and cylindrical shape of Vennola's drum do not allow for stackability. Additionally, the drum's heads require specialty moldings which can be expensive to produce. The Vennola drum apparatus is not a drum set and cannot produce a variety of tones.

Green, U.S. Pat. No. 4,452,121 discloses a septacussion which has seven bongo drums fastened together with a series of block and bolt mechanisms which are not easily removed. The bongo drums do not stack for easy portability. Bongo drums do not have an integral head and the bongo drum head can be broken when hit with a drum stick. Thus, the bongo is not durable and is not easily collapsible and portable since it must be unbolted using tools.

There is a need for a drum which produces good tonal quality, is affordable, durable and stackable and easily transportable. There is also a need for a drum set which requires no tools to collapse.

Bearing in mind the problems and deficiencies of the prior art, it is therefore an object of the present invention to provide a drumming apparatus for producing a unique tone or sound, tone color or tone quality.

It is another object of the present invention to provide easy storage capability in a small area.

It is another object of the present invention to provide a more affordable instrument for consumers.

It is another object of the present invention to provide an instrument which is easy to carry.

It is another object of the present invention to provide an instrument which is easily portable.

It is another object of the present invention to provide an instrument which creates a variety of pitch characteristics.

A further object of the invention is to provide a durable instrument.

It is yet another object of the present invention to provide an instrument which does not require tuning.

Still other objects and advantages of the invention will in part be obvious and will in part be apparent from the specification. The aforementioned objects and advantages are illustrative of the objects and advantages of the various embodiments of the present invention. One of ordinary skill in the art would realize that each particular object is unique and may not necessarily be achieved by a particular embodiment of the present invention. However, each object is achieved by at least one embodiment of the present invention.

SUMMARY OF THE INVENTION

The above and other objects and advantages, which will be apparent to one of skill in the art, are achieved in the present invention which is directed to, in a first aspect, a drumming apparatus comprising a substantially bucket shaped shell with a drum head and a soft fabric covering on the drum head and drum sticks covered with a fabric covering.

In another aspect, the device of the present invention is directed a drumming apparatus comprising a plurality of substantially bucket shaped shells, each shell having a drum head with a soft fabric covering and drum sticks covered with a fabric covering. The plurality of substantially bucket shaped shells fastened together using a fastening system, such as, for example, Velcro™.

In another aspect, the present invention is directed to a drumming apparatus comprising a plurality of substantially bucket shaped shells, each shell having a drum head with a soft fabric covering and drum sticks covered with a fabric covering. The plurality of substantially bucket shaped shells fastened comprising a plurality of substantially bucket shaped shells, each shell having a drum head with a soft fabric covering and drum sticks covered with a fabric covering. The plurality of substantially bucket shaped shells fastened to a frame using a fastening system, such as, for example, Velcro™. The frame having a number of arc shaped segments with each segment conforming to the shape of at least one of the plurality of bucket shaped shells.

In another aspect, the present invention is directed to a drumming apparatus comprising a substantially bucket shaped shells having a drum head with a soft fabric covering and drum sticks covered with a soft fabric covering. The substantially bucket shaped shells resting on a frame which is formed with a open frame sides. The frame has three opposing pairs of sides. Two of the opposing pairs of sides are parallel. The third pair of sides is not parallel and one of these sides, a sloping side. The open end of the drum is placed on the sloping side of the frame where it rests with the assistance of the protrusions at the intersecting corners of the frame which are adjacent to the sloping side. The open frame provides a way to hold the drum and allows sound to exit out the open end of the shell. Thus the sound produced is not muffled and has a unique tone color.

In another aspect, the present invention is direct to a an a drumming apparatus comprising a substantially bucket shaped shell with a drum head, a soft fabric covering on the drum head, and legs and drum sticks covered with a fabric is covering. The legs are for holding the open end of the shell off of its supporting surface. The legs may be attached by a fastening system or they may be clothespins.

DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings. The above and other objects and advantages of the present invention will be apparent upon consideration of the following detailed description, taken in conjunction with accompanying drawings, in which like reference characters refer to like parts throughout, and in which:

DETAILED DESCRIPTION OF THE PRESENT INVENTION

Figure 1:
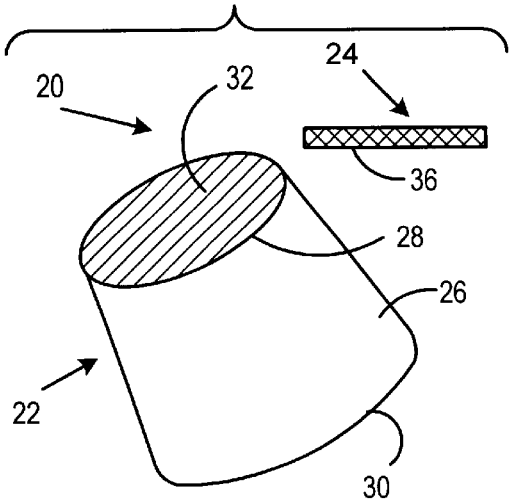
FIG. 1 is a perspective view of one embodiment of the drumming apparatus of the present invention.

In describing the preferred embodiment of the present invention, reference will be made herein to FIGS. 1–10 of the drawings in which like numerals refer to like features of the invention. Features of the invention are not necessarily shown to scale in the drawings.

FIG. 1 illustrates one embodiment of a drumming apparatus 20 of the present invention. The drum apparatus 20 comprises a drum 22 and drum sticks 24. The drum 22 comprises a plastic shell 26 which is substantially shaped like a bucket. For this embodiment, the drum shell 26 is preferably a plastic bucket sold under the trademark PLASTICAN™ bucket, 2 gallon size, manufactured by Plastican Inc. of Leominster, Mass., although other brand buckets and/or sizes may be used. While ready made buckets are preferred, a mold of a bucket shaped shell could be specially made; however, this could increase the cost of the drumming apparatus. PLASTICAN™ buckets of various sizes are also preferred for the other embodiments of the present invention. The bucket shape of the drum shell 26 makes the drum stackable when the drum apparatus is presented in a multiple drum shell configuration or when several drum apparatuses are possessed. The shell 26 has an integral head 28 and an open end 30. The integral head 28 is covered with a first fabric covering 32. The fabric covering 32 can be adhered to the integral head by any suitable adhesive, such as, for example, glue or adhesive. Preferably, the fabric 32 has a sticky side, such as pressure-sensitive adhesive-backing, which is adhered to the integral head 28 and is $1/16^{th}$ inch thick felt sold under the trademark BOSTON FELT™, manufactured by Boston FELT Company Inc. of East Rochester, New Hampshire. Other brand and/or thicknesses and/or fabrics may be used for the fabric covering 32. The drum stick 24 comprises an elongated member with a cylindrical exterior surface 36. Two drumsticks are preferred to better facilitate drumming with the drum apparatus 20. The drum 22 may have a strap (not shown) fastened to it with a fastening system, such as, for example, Velcro™ brand fastening system.

Figure 2:
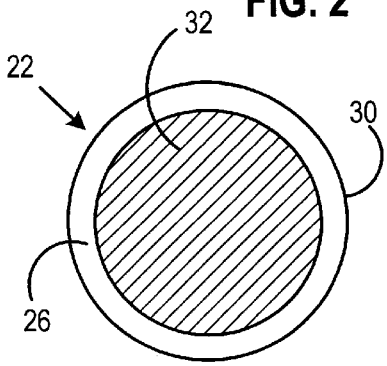
FIG. 2 is a top view of one embodiment of the drum of the present invention.

FIG. 2 illustrates a top view of the embodiment of FIG. 1 of the drum 22 of the present invention. The figure illustrates the circumference of the integral head 28 which is smaller than the circumference of the open end 30 of the drum 22, as is typical of a bucket shape.

Figure 3:
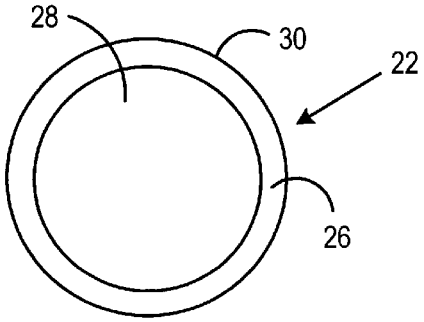
FIG. 3 is a bottom view of one embodiment of the drum of the present invention.

FIG. 3 illustrates a bottom view of the embodiment of FIG. 1 of the drum 22 of the present invention. The figure illustrates the circumference of the integral head 28 which is smaller than the circumference of the open end 30 of the drum 22, as is typical of a bucket shape.

Figure 4:
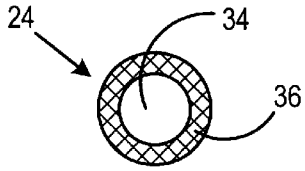
FIG. 4 is a side view of the drum stick of the present invention.

FIGS. 4 illustrates a side view of one embodiment of the drum stick 24 of the present invention illustrating a second fabric covering 36 around the cylindrically shaped elongated member 34. Additionally, a strap (not shown) may be fastened at each end of the drum stick 24 to provide additional support for holding the second fabric covering 36 to the elongated member 34. The elongated member 34 is preferably a wooden dowel of ½ inch diameter, such as, for example, a ½ inch diameter wooden dowel manufactured by American Molding. However, any suitable size, brand and/or material may be used for the elongated member 34. The fabric covering 36 can be adhered to the elongated member 34 by any suitable adhesive, such as, for example, glue or adhesive. Preferably, the fabric 36 has a sticky side for adhering the fabric to the elongated member 34. The preferred fabric covering 36 is Boston Felt, $1/16^{th}$ inch thick and is wrapped around the elongated member 34 four times. However, other brands and/or thicknesses and/or fabrics may be used and may be wrapped around the elongated member any suitable number of times to create a padding on the drum stick 34. Preferably, the thickness of the fabric covering 36 wrapped on the elongated member 34 is thicker than the fabric covering 32 on the integral head 28.

Figure 5:
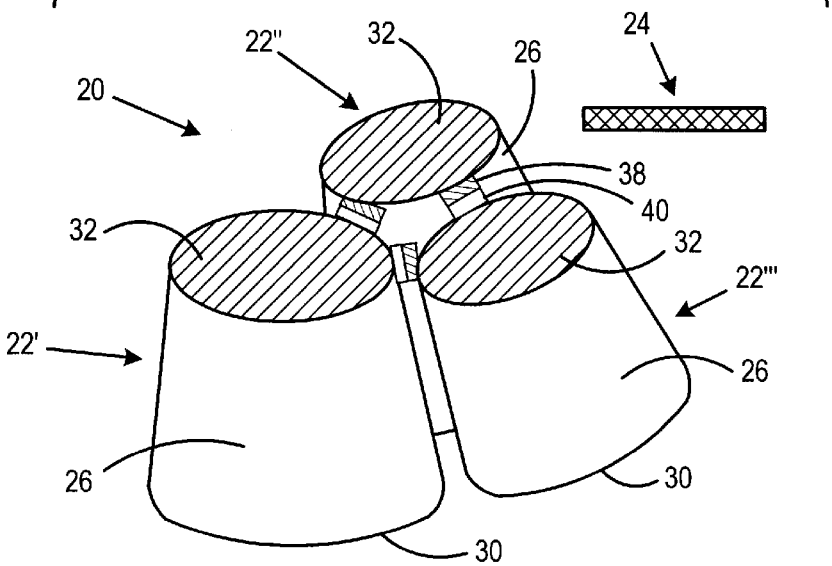
FIG. 5 illustrates an embodiment of the present invention where smaller drums are attached to a larger drum which provides support.

FIG. 5 illustrates another embodiment of the drum apparatus 20 of the present invention. Three drums 22', 22" and 22'" are shown fastened together. Three drums 22', 22" and 22'" are shown for illustrative purposes, however one of ordinary skill in the art would understand that other numbers of drums 22 may be fastened together to create the drum apparatus 20. The drums of the embodiment include large drum 22' and smaller drums 22" and 22'". The preferable size of drum 22' is 3½ gallons, drum 22" is 2 gallons and 22'" is 1 gallon. However, other suitable sizes may be used. The size of the drum 22 corresponds to the tone produced by the drum when the drum is stuck. The fastening system for the drumming apparatus is preferred to be a system which uses strip of tiny loops and strip of tiny hooks, such as, for example Velcro™ brand fastening system. However, other similar fastening systems which fasten objects and allow for easy unfastening could be used. In the embodiment of FIG. 5, the drums 22 are fastened together whereby at least a portion, of the strip of tiny loops 38 and strip of tiny hooks 40 fastening system is adhered to each drum 22 at the shell 26 and each shell is attached to at least one other shell by attaching oppositely configured strips of the fastening system. One of ordinary skill in the art would understand that the positioning of a particularly configured strip on a particular shell is not necessary, so long as oppositely configured strips are adjacently mated when attaching the drums 22 together.

Figure 6:
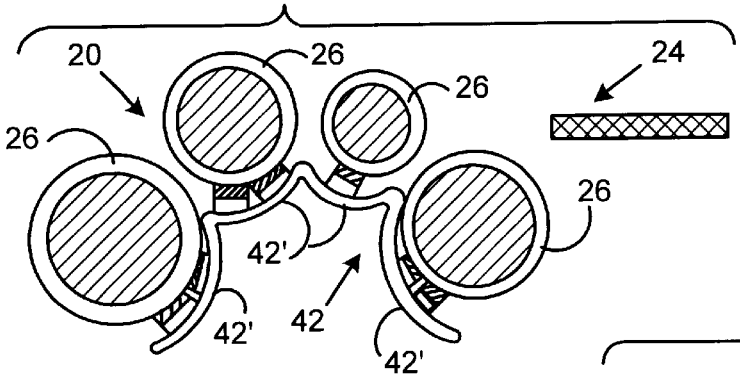
FIG. 6 illustrates an embodiment of the present invention where multiple drums are attached to a frame.

FIG. 6 illustrates another embodiment of the drum apparatus 20 in which multiple drums 22 are attached to a frame 42. The frame has an arc shaped segments 42' for each drum in the apparatus 20. Each arc shaped segment 42' generally conforms to the shape of one of the drum shells 26. The preferred fastening system for the drums 22 and frame 42 is the strip of tiny loops 38 and strip of tiny hooks 40 fastening system described above.

Figure 7:
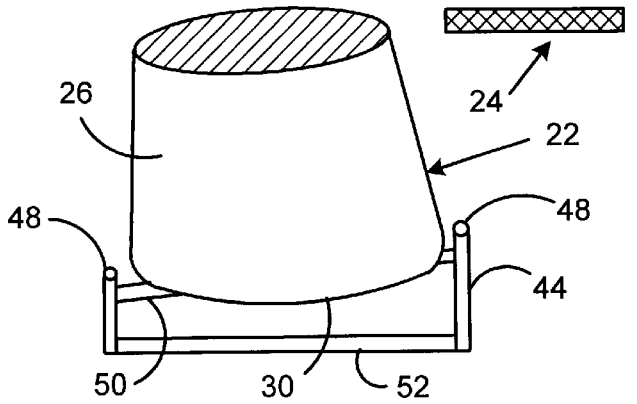
FIG. 7 is a side view of an embodiment of the present invention illustrating a drum resting on a frame.
Figure 8:
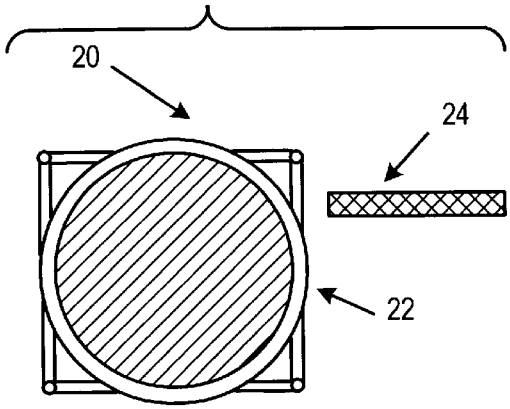
FIG. 8 is a top view of the embodiment of FIG. 7 illustrating the drum resting on a frame.

FIG. 7 illustrates another embodiment of the drum apparatus 20 of the present invention. The figure illustrates the side view of a drum 22 resting on a frame 44. The frame generally is a three dimensional trapezoidal shape and is formed with open frame sides. The frame has three opposing pairs of sides. Two of the opposing pairs of sides are parallel. The third pair of sides is not parallel and one of these sides, a sloping side 50, slopes at an acute angle to its opposite side 52. The open end 30 of the drum 22 is placed on the sloping side of the frame where it rests with the assistance of the frame protrusions 48 at the intersecting corners of the frame which are adjacent to the sloping side 50. FIG. 8 illustrates a top view of the drum 22 positioned on the frame of FIG. 7. Other three dimensional open frame shapes are within the scope of this embodiment.

Figure 9:
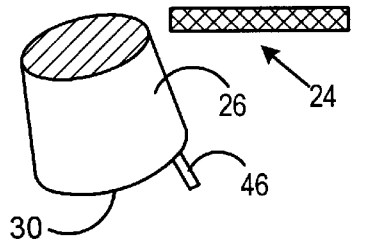
FIG. 9 is a perspective view of an embodiment of the present invention illustrating legs attached to the drum.

FIG. 9 illustrates another embodiment of the drum apparatus 20 of the present invention whereby the drum 22 has legs 46 attached at the open end 30. The preferred method of attachment is with a strip of tiny loops and strip of tiny hooks fastening system, such as, for example, Velcro™ brand fastening system. However other suitable attachment means such as snaps or spring mechanism such as that of a clothespin may be used.

The legs and frames of the various embodiments allow sound to escape from the drum so that it is not muffled or quieted. However, if legs or a frame are not used, and the drum is placed on a substrate such as a floor or table the sound will be muffled or quieted. Further quieting may be desirable some situations, such as in a home, and the drumming apparatus can be placed on a rug to produced the desired quieting effect.

Figure 10:
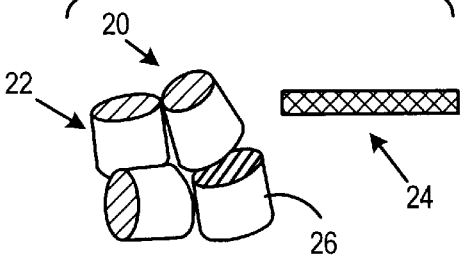
FIG. 10 is an embodiment of the present invention illustrating multiple drums in a drum set configuration.

FIG. 10 illustrates another embodiment of the drum apparatus 20 of the present invention showing the drums 22 arranged in a drumming set configuration.

The present invention is a drumming apparatus which comprises a drum with soft material on the striking surface and sticks, also covered with a soft material. This combination of materials creates pleasant unique sounds or tonal colors created by a combination of tonal properties of pitch, duration, intensity and quality. Different pitches can be obtained by the use of different size drums. The drumming apparatus can be played in many environments such as schools, homes and neighborhoods because of its likeable sound which is not loud and sharp as compared to the sounds produced by drumming instruments of the prior art. The drum is inexpensive and can be available to a many more drummers, such as students, as compared to expensive prior art drumming instruments. The drum, when worn, can be replaced. The drumming apparatus of the present invention does not require electronics or power sources. Manufacturing of the drumming apparatus can also be performed less expensively than the prior art by utilizing ready made buckets for the drum shell and by using simple fastening techniques such as pressure sensitive adhesive and tiny hook and loop type fastening systems. More drummers of all ages can experience the pleasure of music and rhythm more easily at much less cost and produce a unique sound or tonal color.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

We claim:

1. A drumming apparatus comprising:

a plastic shell having substantially a bucket shape with an integral head and an open end;

a first fabric covering having a first thickness, the fabric covering adhered to an entire surface of the integral head;

at least one elongated member comprising a cylindrical exterior surface; a second fabric covering, having a second thickness greater than the thickness of the first fabric covering, the second fabric covering adhered to the entire cylindrical exterior surface of the elongated member;

whereby the elongated member is used to strike the integral head of the plastic shell to produce a sound.

2. A drumming apparatus as claimed in claim 1 wherein the plastic shell is a PLASTICAN™ plastic bucket.

3. A drumming apparatus as claimed in claim 1 wherein the first fabric is felt.

4. A drumming apparatus as claimed in claim 3 wherein the second fabric is felt.

5. A drumming apparatus as claimed in claim 1 further comprising:

a frame having a substantially trapezoidal shape whereby the open end of the plastic shell is positioned on one side of the trapezoidal frame.

6. A drumming apparatus as claimed in claim 1 further comprising:

at least two removable legs fastened to the open end of the plastic shell.

7. A drumming apparatus as claimed in claim 6 wherein the two removable legs are clothes pins clipped onto the open end of the plastic shell.

8. A drumming apparatus as claimed in claim 6 wherein the two removable legs are fastened with the strip of tiny loops and strip of tiny hooks fastening system adhered to the plastic shell adjacent to the open end.

9. A drumming apparatus as claimed in claim 6 wherein the two removable legs are fastened with snaps to the plastic shell adjacent to the open end.

10. A drumming apparatus comprising:

a plurality of plastic shells, each shell having substantially a bucket shape with an integral head and an open end;

a first felt covering having a first thickness adhered to an entire surface of each integral head;

a strip of tiny loops and strip of tiny hooks fastening system for fastening the plastic shells together whereby at least one portion of fastening system is adhered to each of the plurality of plastic shells and whereby the plurality of plastic shells are fastened together in a configuration in which each plastic shell is fastened to at least one other plastic shell by attaching oppositely configured strips of the fastening system;

at least one elongated member comprising a cylindrical exterior surface;

a second felt covering, having a second thickness greater than the thickness of the first felt covering, the second felt covering adhered to the entire cylindrical exterior surface of the elongated member;

whereby the elongated member can be used to strike the integral head of the plastic shell to produce a sound.

11. A drumming apparatus as claimed in claim 10 whereby the plurality of plastic shells each create a particular sound with particular pitch characteristics corresponding to the size of the plastic shell.

12. A drumming apparatus comprising:

a plurality of plastic shells, each shell having substantially a bucket shape with an integral head and an open end, whereby the plurality of plastic shells comprises:

a first bucket, the first bucket having a 3½ gallon size;

a second bucket, the second bucket having a 2 gallon size; and a third bucket, the third bucket having a 1 gallon size;

whereby the plurality of plastic shells are stackable;

a first felt covering having a first thickness adhered to each integral head;

a strip of tiny loops and strip of tiny hooks fastening system for fastening the plastic shells together whereby at least one sex of fastening system is adhered to each of the plurality of plastic shells and whereby the plurality of plastic shells are fastened together in a configuration in which each plastic shell is fastened to at least one other plastic shell by attaching oppositely sexed strips of the fastening system;

at least one elongated member comprising a cylindrical exterior surface; and a second felt covering, having a second thickness greater than the thickness of the first felt covering, the second felt covering adhered to the cylindrical exterior surface of the elongated member;

whereby the elongated member can be used to strike the integral head of the plastic shell to produce a sound.

13. A drumming apparatus comprising:

a plurality of plastic shells, each shell having substantially a bucket shape with an integral head and an open end, and a felt covering having a first thickness adhered to each integral head;

a frame for holding the plurality of plastic shell, said frame comprising substantially arc shaped segments, each arc shape segment conforming to the shape of at least one of the plurality of plastic shells of the drumming apparatus;

a strip of tiny loops and strip of tiny hooks fastening system for fastening each plastic shell to the frame whereby at least one strip of the fastening system is adhered to each of the plurality of plastic shells and whereby the plurality of plastic shells are fastened to the frame with oppositely configured strips of the fastening system;

at least one elongated member comprising a cylindrical exterior surface;

a second felt covering, having a second thickness greater than the thickness of the first felt covering, the second felt covering adhered to the cylindrical exterior surface of the elongated member;

whereby the elongated member can be used to strike the integral head of the plastic shell to produce a sound.

14. A drumming apparatus as claimed in claim 13 whereby the plurality of plastic shells are stackable.

15. A drumming apparatus as claimed in claim 14 whereby the plurality of plastic shells comprises:

a first bucket, the first bucket having a 4 gallon size;

a second bucket, the second bucket having a 3½ gallon size;

a third bucket, the third bucket having a 2 gallon size; and a fourth bucket, the fourth bucket having a 1 gallon size.

16. A drumming apparatus comprising:

first, second and third plastic shells, each shell having substantially a bucket shape with an integral head and an open end, the first shell comprising a 3½ gallon bucket, the second shell comprising a 2 gallon bucket and the first shell comprising a 1 gallon bucket;

a first felt covering, having a thickness of $1/16^{th}$ inch, adhered to each integral head;

a strip of tiny loops and strip of tiny hooks fastening system for fastening the first, second and third plastic shells together whereby at least one strip of the fastening system is adhered to each of the plurality of plastic shells and whereby the first, second and third plastic shells are fastened together in a configuration in which each plastic shell is fastened to at least one other plastic shell by attaching oppositely configured strips of the fastening system;

at least one elongated member comprising a cylindrical exterior surface, the elongated member being a wooden dowel;

a second felt covering, having a thickness of ¼ inch adhered to the cylindrical exterior surface of the elongated member;

whereby the elongated member can be used to strike the integral head of the plastic shell to produce a sound.

17. A drumming apparatus as claimed in claim 16 whereby the plurality of plastic shells are stackable.

18. A drumming apparatus as claimed in claim 16 whereby the plurality of plastic shells each create a particular sound with particular pitch characteristics corresponding to the size of the plastic shell.

* * * * *